US006764200B1

(12) United States Patent
Wu Liu

(10) Patent No.: US 6,764,200 B1
(45) Date of Patent: Jul. 20, 2004

(54) DECORATIVE LANTERN

(76) Inventor: Hsiang Lan Wu Liu, No.1, Alley 466, Weigung Rd., Miaoli City, Miaoli (TW), 360

( * ) Notice: Subject to any disclaimer, the term of this patent is extended or adjusted under 35 U.S.C. 154(b) by 0 days.

(21) Appl. No.: 10/342,230

(22) Filed: Jan. 15, 2003

(51) Int. Cl.[7] ..... F21V 1/06
(52) U.S. Cl. ..... 362/352; 362/360; 362/361
(58) Field of Search ..... 362/235, 249, 362/351, 352, 355, 356, 360, 361, 450, 806

(56) References Cited

U.S. PATENT DOCUMENTS 1,759,093 A * 5/1930 Clawson ..... 362/352
D236,999 S * 9/1975 Tongson et al. ..... 362/360
6,206,551 B1 * 3/2001 Stubblefield, Jr. ..... 362/360
6,629,770 B2 * 10/2003 Blatherwick ..... 362/363

* cited by examiner

*Primary Examiner*—Y My Quach Lee
(74) *Attorney, Agent, or Firm*—Troxell Law Office PLLC

(57) ABSTRACT

A decorative lantern includes a plurality of constituent pieces made of a light-transmissible, heat-resisting, and flexible plastic material. Each of the constituent pieces has a radially inner zone at a first side thereof, and a radially outer zone at a second side thereof, and is formed at a radially inner edge with at least one recess portion. The constituent pieces are sequentially connected together by bonding the radially inner zone at the first side of a first constituent piece to a second constituent piece adjacent to the first side of the first constituent piece, and bonding the radially outer zone at the second side of the first constituent piece to a third constituent piece adjacent to the second side of the first constituent piece; and the recess portions of all the constituent pieces together define a receiving space in the decorative lantern for accommodating an electrically conductive light source therein.

7 Claims, 6 Drawing Sheets

DECORATIVE LANTERN

BACKGROUND OF THE INVENTION

The present invention relates to a decorative lantern, and more particularly to a decorative lantern that is suitable for connecting to a light-emitting ornament, such as a lamp string, to create an enhanced decorating effect.

In the past, a lantern was used as a lighting means in the night, and usually included a cylindrical hollow body having a constantly flammable light source provided therein, so that the lantern could be carried with a hand or hung on somewhere for use. Today, the lantern has been completely replaced by an electric lamp in our daily life. Nevertheless, the lantern is still a good ornament due to a graceful formation thereof and soft light beams emitted therefrom.

Typically, the lantern has a cylindrical hollow body made of a paper material and a light-source mount provided in the cylindrical body. Since the body of the paper lantern has an insufficient structural strength, it is generally necessary to reinforce the lantern body with wood or bamboo. The wood or bamboo reinforcement largely complicates the manufacturing process of the paper lantern to increase the time and labor costs thereof and prevents the lantern from being mass-produced.

Moreover, the conventional paper lantern is not heat-resistant and therefore not safe for use with a modern light-emitting ornament, such as a lamp in a lamp string that is normally continuously lightened for a prolong time and would therefore produce a considerably high temperature.

SUMMARY OF THE INVENTION

A primary object of the present invention is to provide a decorative lantern suitable for use with a light-emitting ornament as an additional decoration thereof.

To achieve the above and other objects, the decorative lantern of the present invention includes a plurality of constituent pieces made of a light-transmissible, heat-resisting, and flexible plastic material. Each of the constituent pieces has a radially inner zone at a first side thereof, and a radially outer zone at a second side thereof, and is formed at a radially inner edge with at least one recess portion. The constituent pieces are sequentially connected together by bonding the radially inner zone at the first side of a first constituent piece to a second constituent piece adjacent to the first side of the first constituent piece, and bonding the radially outer zone at the second side of the first constituent piece to a third constituent piece adjacent to the second side of the first constituent piece; and the recess portions of all the constituent pieces together define a receiving space in the decorative lantern for accommodating an electrically conductive light source therein.

In a preferred embodiment of the present invention, the electrically conductive light source is a lamp adapted for connecting to a light-emitting ornament, such as a lamp string, so that the lantern forms an ornamental component of the light-emitting ornament.

In other feasible embodiments of the present invention, the radially inner and outer zones separately at two sides of different constituent pieces for bonding purpose may be flexibly designed to have different areas and lengths, so as to create different shapes for the decorative lantern.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
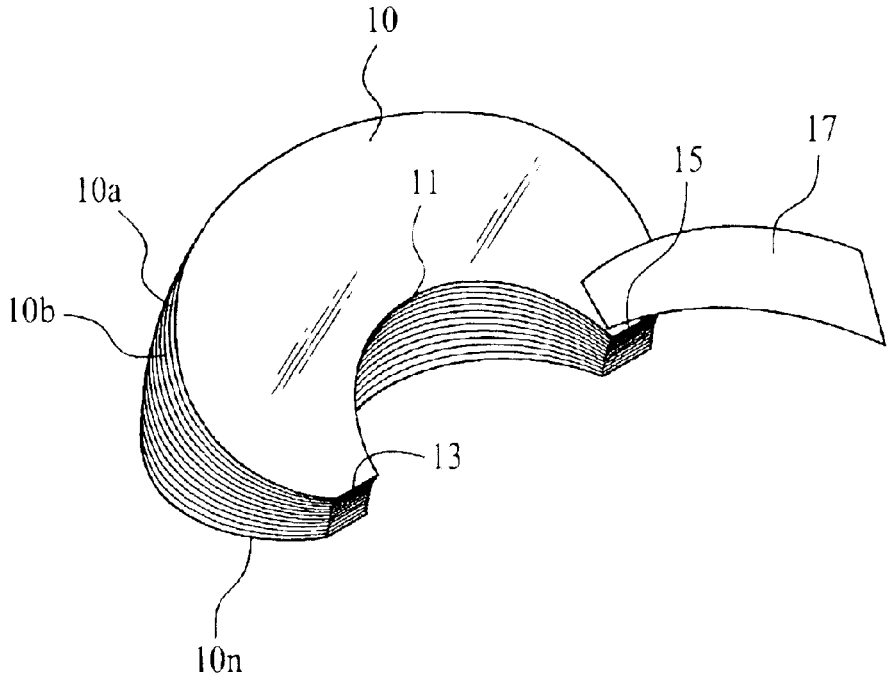
FIG. 1 is a perspective view of a decorative lantern according to a preferred embodiment of the present invention in a fully collapsed state.
Figure 2:
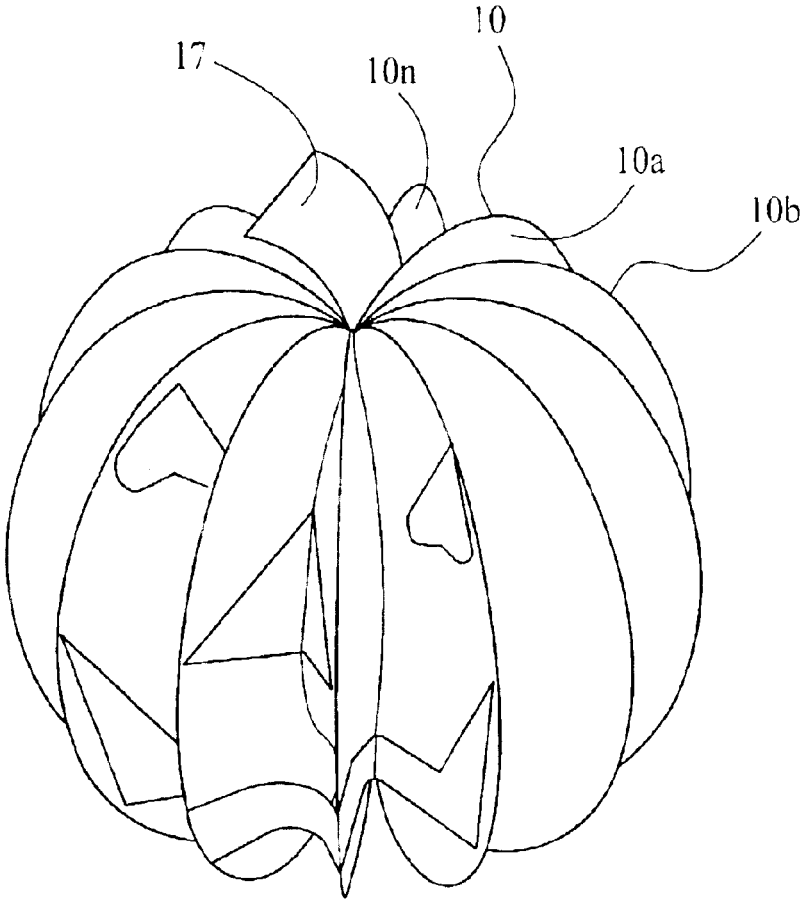
FIG. 2 is a perspective view of the decorative lantern of FIG. 1 in a fully stretched state.

Please refer to FIGS. 1 and 2 that are collapsed and stretched perspective views, respectively, of a pumpkin-shaped decorative lantern according to a preferred embodiment of the present invention. The pumpkin-shaped lantern is one embodiment of the invention. The lantern can be formed in many other shapes.

As shown in FIGS. 1 and 2, the decorative lantern of the present invention includes a plurality of constituent pieces 10, 10*a*, 10*b*, . . . , and 10*n* that are sequentially bonded together to form the lantern. In the illustrated preferred embodiment of FIGS. 1 and 2, the constituent pieces 10, 10*a*, 10*b*, . . . , and 10*n* are in the same shape and can therefore be quickly mass-produced.

The constituent pieces 10, 10*a*, 10*b*, . . . , and 10*n* are preferably made of a light-transmissible, heat-resisting, and flexible plastic material, such as polyethylene, which is a suitable low-cost material for the present invention.

Each of the constituent pieces 10, 10*a*, 10*b*, . . . , and 10*n* is provided at a radially inner edge with at least one recess portion 11, so that all the recess portions 11 may together form a receiving space in the decorative lantern formed from these constituent pieces 10, 10*a*, 10*b*, . . . , and 10*n*. In the illustrated preferred embodiment of the present invention, each of the constituent pieces 10, 10*a*, 10*b*, . . . , and 10*n* has two radially extended end portions 13, 15 that have a predetermined small length. In the preferred embodiment, the constituent pieces 10, 10*a*, 10*b*, . . . , and 10*n* are substantially in the shape of a crescent with two ends being cut out to form the above-mentioned radially extended short-length end portions 13, 15. If necessary, a decorative piece 17 having a desired shape may be connected to at least one of the constituent pieces 10, 10*a*, 10*b*, . . . , and 10*n*. In the illustrated pumpkin-shaped lantern, the decorative piece 17 may be in the form of a stem of a pumpkin.

Figure 3:
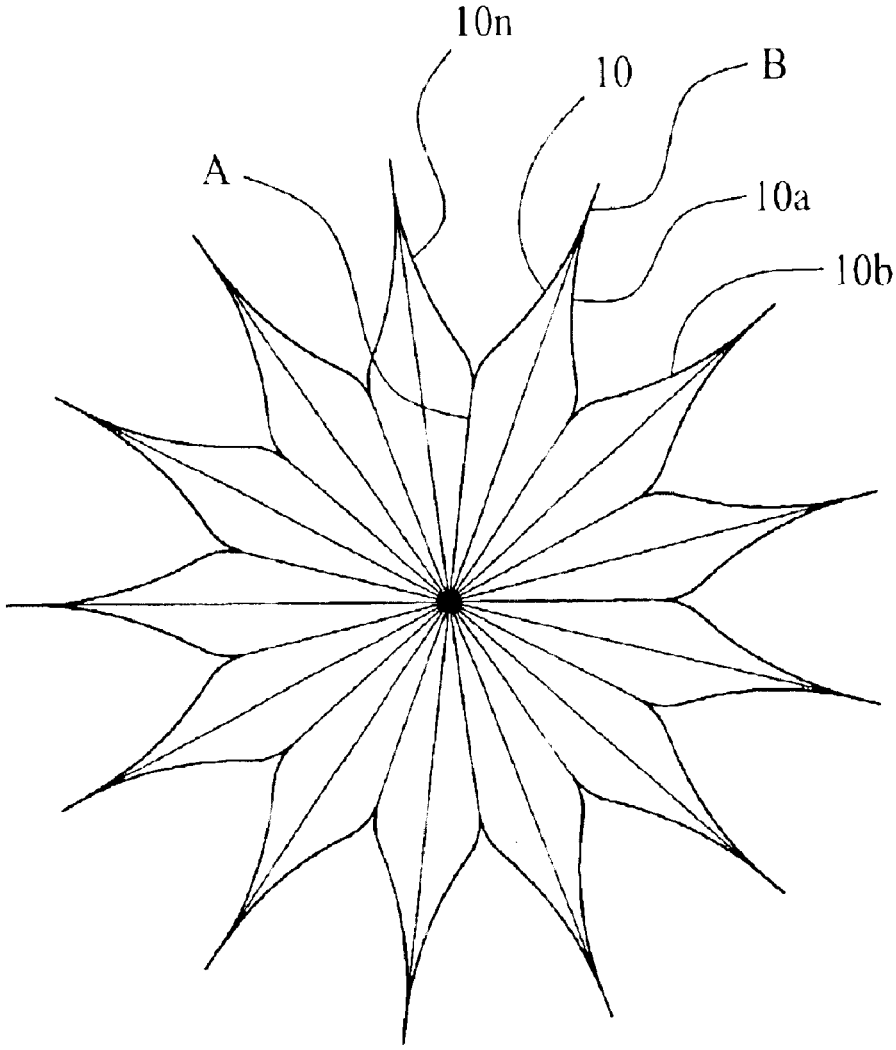
FIG. 3 is a top view of FIG. 2.

FIG. 3 is a top view of the pumpkin-shaped lantern of FIG. 2, from which a preferred manner of bonding the constituent pieces 10, 10*a*, 10*b*, . . . , and 10*n* together to form the lantern can be seen. Please refer to FIG. 3. Each constituent piece has a radially inner zone A at a first side thereof bonded to another constituent piece adjacent to that first side, and a radially outer zone B at a second side thereof bonded to a further constituent piece adjacent to that second side. For example, the constituent piece 10 and the constituent piece 10*n* adjacent to a left side of the constituent piece 10 are partially bonded together at their respective radially inner zones A facing toward each other, and the constituent piece 10 and the constituent piece 10*a* adjacent to a right side of the constituent piece 10 are partially bonded together at their respective radially outer zones B facing toward each other. In this manner, all the constituent pieces 10, 10*a*, 10*b*, . . . , and 10*n* are sequentially bonded together to form a continuously stacked and stretchable structure, as shown in FIG. 1. When the continuously stacked and bonded constituent pieces 10, 10*a*, 10*b*, . . . , and 10*n* of FIG. 1 is stretched, and the first and the last constituent pieces 10, 10*n* are finally bonded together in the above-described manner, a finished product of decorative pumpkin lantern is formed.

After all the constituent pieces 10, 10*a*, 10*b*, . . . , and 10*n* are bonded together in the above-described manner and then stretched, the bonded radially inner zones A and the bonded radially outer zones B form fixed and non-separable confines, while other areas on the constituent pieces that are not bonded together are expanded in the process of stretching to form the pumpkin-shaped lantern as shown in FIGS. 2 and 3. The zones A, B on different constituent pieces for bonding purpose may have different areas and lengths. That is, there are a variety of choices for the sizes of the bonding zones A, B to form decorative lanterns of different appearances.

Figure 4:
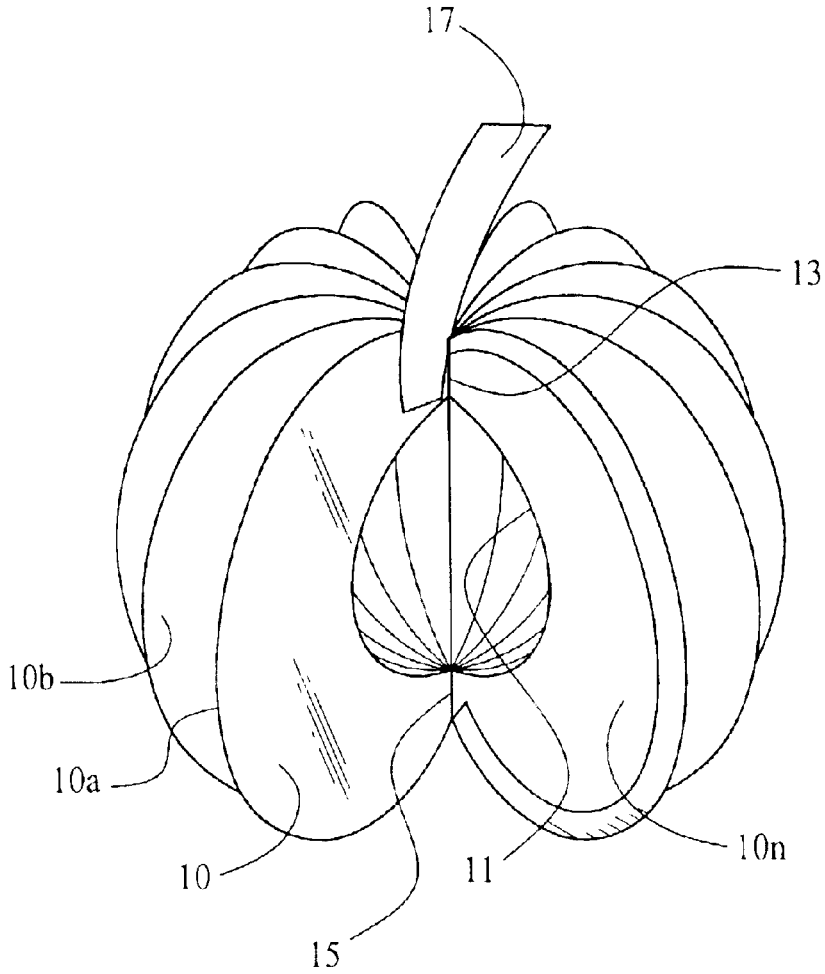
FIG. 4 is a perspective view of the decorative lantern of FIG. 1 in a stretched state and ready for final bonding to form a complete body.
Figure 5:
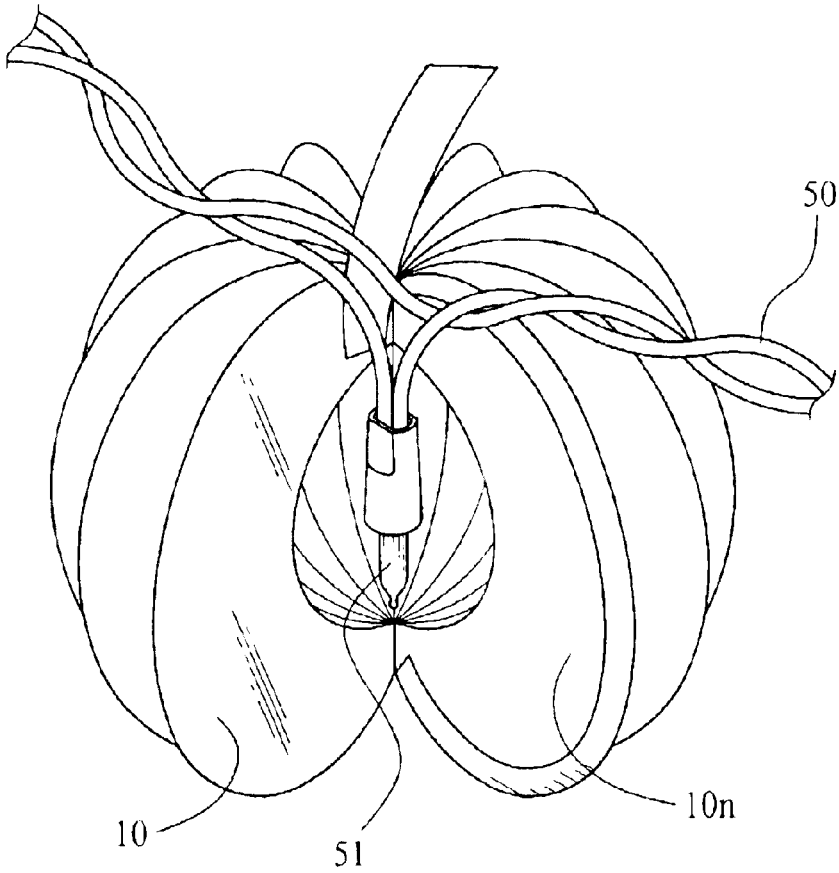
FIG. 5 is a perspective view of the decorative lantern of FIG. 1 including a lamp string with a lamp mounted in the lantern before the lantern is finally bonded to form a complete body.

Please refer to FIGS. 4 and 5. According to a further embodiment of the present invention, an electrically conductive light source 5l, such as a lamp, may be mounted in the receiving space of the decorative lantern before the first constituent piece 10 and the last constituent piece 10*n* are bonded to each other. In this further embodiment of the present invention, the lamp 51 may be a part of a light-emitting decoration, such as a lamp string 50, so that the decorative lantern having the lamp 51 mounted therein forms an ornamental component of the lamp string 50 to create an enhanced decorating effect for the lamp string 50.

Figure 6:
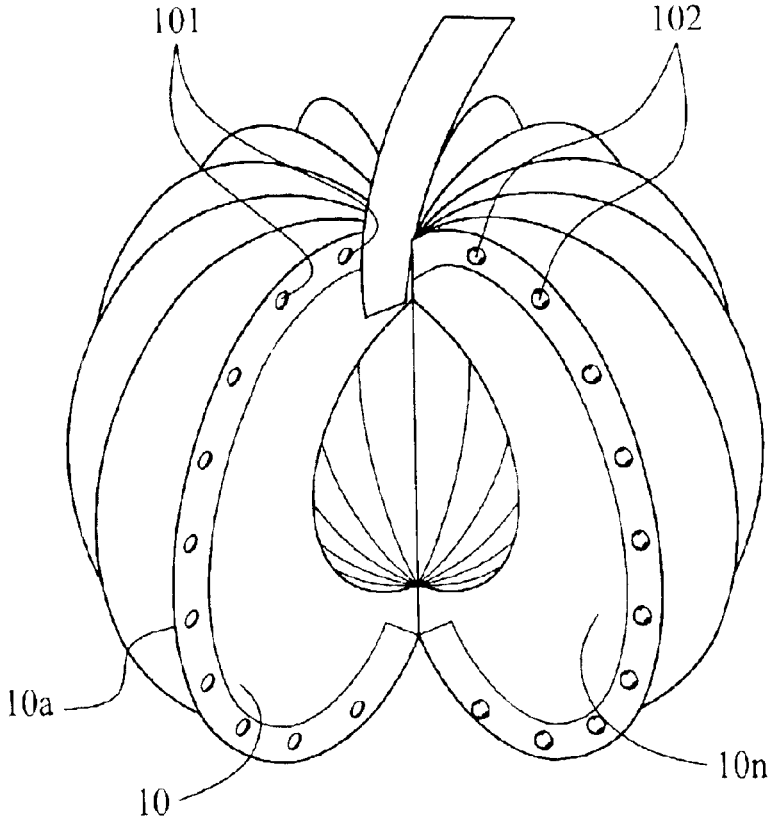
FIG. 6 is a perspective view of another embodiment of the present invention in which dents and dots are correspondingly provided on the first and the last constituent piece forming the lantern for connecting the two constituent pieces to each other.

FIG. 6 shows another embodiment of the present invention. In this embodiment, the first and the last constituent piece 10, 10*n* are provided at surfaces facing toward each other with corresponding dents 101 and dots 102, respectively. After a conductive light source has been mounted in the receiving space of the decorative lantern, the first and the last constituent piece 10, 10*n* may be connected to each other by engaging the dents 101 with the dots 102, so as to form a complete decorative lantern.

The present invention has been described with some preferred embodiments thereof and it is understood that many changes and modifications in the described embodiments can be carried out without departing from the scope and the spirit of the invention as defined by the appended claims.

What is claimed is:

1. A decorative lantern, comprising a plurality of constituent pieces made of a light-transmissible, heat-resisting, and flexible material; each of said constituent pieces having a radially inner zone at a first side thereof, and a radially outer zone at a second side thereof, and being formed at a radially inner edge with at least one recess portion; said constituent pieces being sequentially connected together by bonding said radially inner zone at said first side of a first said constituent piece to a second said constituent piece adjacent to said first side of said first constituent piece, and bonding said radially outer zone at said second side of said first constituent piece to a third said constituent piece adjacent to said second side of said first constituent piece; and said recess portions of all said constituent pieces together define a receiving space in said decorative lantern formed from said sequentially bonded constituent pieces for accommodating an electrically conductive light source therein before a first one and a last one of said constituent pieces are connected to each other.

2. The decorative lantern as claimed in claim 1, wherein each of said constituent pieces has two radially extended end portions having a predetermined short length.

3. The decorative lantern as claimed in claim 1, wherein said electrically conductive light source comprises a lamp.

4. The decorative lantern as claimed in claim 3, wherein said lamp is part of a light-emitting ornament.

5. The decorative lantern as claimed in claim 4, wherein said light-emitting ornament comprises a lamp string.

6. The decorative lantern as claimed in claim 1, wherein said first and said last constituent piece are connected to each other through bonding.

7. The decorative lantern as claimed in claim 1, wherein said first and said last constituent piece are connected to each other through engagement of dents and dots correspondingly provided on surfaces of said first and last constituent pieces facing toward each other.

* * * * *